United States Patent [19]

Dunwoodie

[11] Patent Number: 4,960,027

[45] Date of Patent: Oct. 2, 1990

[54] BRIDGE FOR A STRINGED INSTRUMENT

[76] Inventor: Dave Dunwoodie, 11200 - 7th Avenue, Richmond, B.C., Canada, V7E 3B9

[21] Appl. No.: 292,531

[22] Filed: Dec. 30, 1988

[51] Int. Cl.[5] ..... G10D 3/04

[52] U.S. Cl. ..... 84/307

[58] Field of Search ..... 84/298, 299, 307, 314 R, 84/314 N

[56] References Cited

U.S. PATENT DOCUMENTS 2,491,788 12/1949 Widowson ..... 84/298

3,712,952 1/1973 Terlinde ..... 84/314 R 4,768,414 9/1988 Wheelwright ..... 84/298

*Primary Examiner*—Brian W. Brown

*Attorney, Agent, or Firm*—Shlesinger & Myers

[57] ABSTRACT

A bridge for a stringed instrument has a string supporting portion comprising a composition having a first component and a second component. The first component is a rigid material and the second component is a lubricating material. Preferably the first component is plastic and the second component is polytetrafluoroethylene, graphite or a silicone. The composition may also include a reinforcement comprising aramid, carbon or glass fibers or combinations thereof.

12 Claims, 1 Drawing Sheet

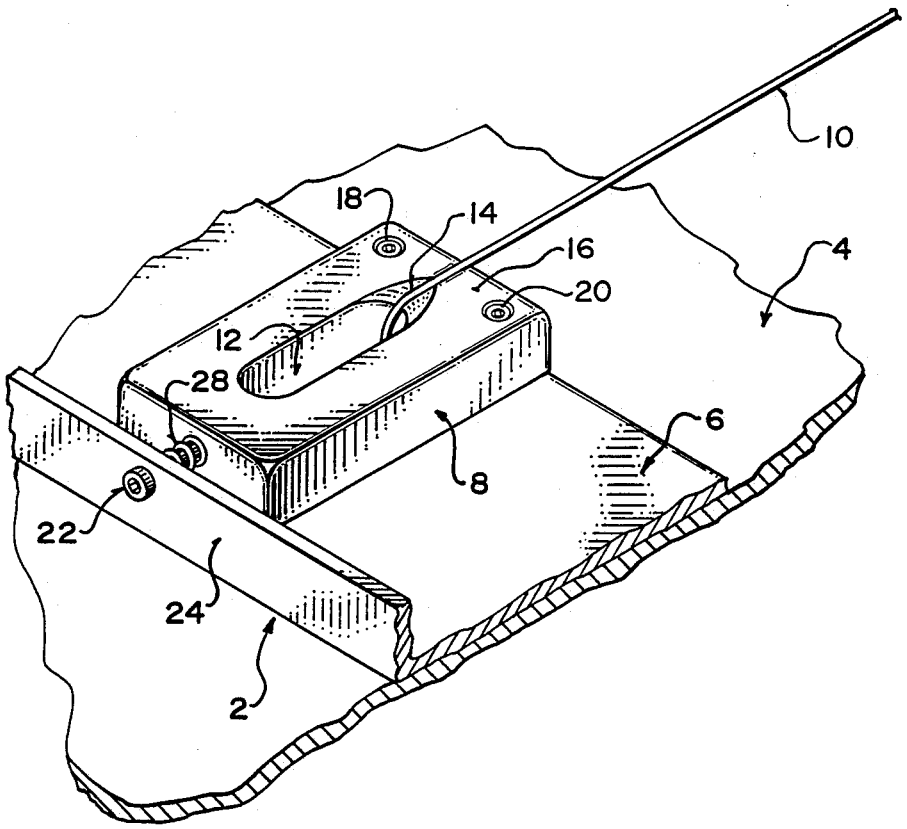
10
18
14
16
20
4
12
28
6
8
22
24
2

BRIDGE FOR A STRINGED INSTRUMENT

BACKGROUND OF THE INVENTION

This invention relates to bridges for stringed instruments and, in particular, to saddles for guitars.

Stringed instruments employ bridges to transmit vibrations to the body of the instrument. For example, a guitar has a bridge mounted on the body of the guitar. The strings run over the bridge which is in contact with the body.

The bridges of electric guitars typically include a plurality of members known as "saddles". Normally there is one saddle for each string. The saddles are connected to the body of the guitar and each string passes over a saddle near the point of connection with the body of the guitar.

Conventionally these guitar saddles are made of metal, such as pressed steel, brass or stainless steel. Each string has a bend at the point of contact with the saddle. This bend has been thought to be the cause of string breakage. String breakage is a serious problem for musicians, particularly when it occurs during a performance or during an expensive recording session. The problem of string breakage has long existed and it has been thought to be an inherent problem with musical instruments with no satisfactory solution available.

Bridge saddles have been developed which have rollers at the point of contact with the string. The rollers are intended primarily as a tuning aid, by easing movement of the string over the bridge when the string is being tuned. However, these rollers have not caused an appreciable reduction in string breakage.

SUMMARY OF THE INVENTION

The invention provides a bridge for a stringed instrument having a string supporting portion comprising a composition having a first component and a second component. The first component is a rigid material and the second component is a lubricating material.

The string supporting portion may be, for example, a saddle for a guitar bridge.

The rigid material may be a plastic material such as a resin and the second component may comprise polytetrafluoroethylene, a silicone or graphite.

The composition may also include a third component comprising reinforcing fibers of, for example, aramid, carbon or glass fibers.

The use of a string supporting portion of the stated composition has provided a dramatic reduction in string breakage of guitars. It is believed that previous string breakage has been due in large measure to friction between the string supporting portion of the bridge and the string. Motion of the string from side to side apparently is a significant factor because the roller-type saddles have not alleviated string breakage. On the other hand, employing a composition with an integral lubricating material has considerably decreased the occurrence of string breakage when compared with conventional metal bridge saddles of the same type.

BRIEF DESCRIPTION OF THE DRAWING

The drawing is an isometric view of a fragment of a guitar body with a fragment of a bridge mounted thereon including one string and one saddle mounted on the bridge.

DESCRIPTION OF THE PREFERRED EMBODIMENT

The drawing shows a fragment of a guitar bridge shown generally at 2 mounted on a fragment of a guitar body 4. The bridge includes an angle-shaped member 6, typically of metal, having a plurality of bridge saddles 8 juxtaposed thereon (only one of which is shown in the drawing). The guitar has a plurality of strings, only one of which, namely string 10, is shown in the drawing. Each saddle has an elongated aperture 12 therethrough with a notch 14 at one end for receiving the string 10. The string passes over front end 16 of the saddle and then over notch 14. The end of the string passes through aperture 12 and a corresponding aperture in member 6 and is fixedly connected to the body of the guitar in the conventional manner. The saddle 8 is secured to member 6 by a pair of Allan bolts 18 and 20 at the front end thereof and by an Allan bolt 22 at the back end thereof which passes through an aperture in flange 24 of member 6. A coil spring 28 is located between the flange 24 and the back of the saddle.

As described so far, the arrangement is conventional and is an example of one type of saddle only. It should be understood that the invention is equally applicable to guitar saddles of other types and, for that matter, to string supporting portions of other musical instruments.

Conventionally saddle 8 is made of metal, such as brass or stamped steel. However, the invention provides a saddle 8 having a body comprised of a composition including a first component and a second component. The first component is a rigid material selected to provide the strength required as well as appropriate sound transmission to the body of the guitar. The second component is a lubricating material selected to provide lubrication for the guitar string at the point of contact with the saddle. In the preferred embodiment there is also a third component to increase the strength and durability of the saddle.

In the preferred embodiment, the first component is a polyphenylene sulfide resin. The second component is polytetrafluoroethylene and the third component is glass fibers. A composition having a suitable combination of the first component, second component and third component is available from Phillips Chemical Co. under the trade mark RYTON. The preferred composition includes proportions by weight of 55 percent polyphenylene sulfide resin, 15 per cent polytetrafluoroethylene and 30 percent glass fibers. However, these proportions may be varied. The polytetrafluoroethylene is mixed homogeniously with the resin and the glass fibers are evenly distributed throughout the composition. The guitar saddles of the preferred embodiment are produced by molding this composition.

It is also believed that polycarbonate resins or acetal resins would be suitable although the latter may not have as good a tone as the preferred polyphenylene sulfide. Desirable properties of the resin or other plastic material are believed to be high tensile strength, high flexural modulus and high stiffness. Other possible substitutes for the first component include amino, polyamide-polyimide, polyester, polyimide thermoset, styrene-acrylonitrile or polyethersulfone resins or nylon.

As stated, the second component is chosen for its lubricant qualities and polytetrafluoroethylene is the preferred component. However, possible alternatives include silicones and graphite.

The composition of the preferred embodiment has glass fiber reinforcement. Alternatives are carbon fibers and aramid fibers. Unreinforced plastic compositions may be substituted.

It should also be understood that the lists of alternatives given above is not necessarily exhaustive. Furthermore, each component may comprise a mixture of two or more of the alternatives given above.

In the preferred embodiment, the entire body of the saddle is molded from the stated composition. Alternatively, only the portion of the saddle contacting the guitar string needs to be made from the lubricating composition. The body could be made of metal, for example, with an insert of the stated composition being fitted thereto for contacting the string.

As a further alternative, the saddle could have a body of metal with a coating of the stated composition at least where the saddle contacts the string.

In operation, the saddles according to the invention are simply fitted to the body of the guitar in a conventional manner after metal saddles are removed. Of course the saddles may also be installed on new guitars. An initial break in time of four to six hours may be required to create a film of lubrication as the strings move over the saddles.

In actual tests, guitar saddles according to the invention have appreciably reduced the rate of string breakage compared with conventional metal saddles. These tests included actual trials of the invention by skilled musicians and workbench tests wherein guitar strings were repetitively plucked by a member similar to a guitar pick. These tests related to compositions according to the preferred embodiment, although it is believed that string breakage would also be reduced employing the alternatives listed above.

Other embodiments of the invention will be apparent to the skilled in the art from a consideration of this specification or practice of the invention disclosed herein. It is intended that the specification and examples be considered as exemplary only with the true scope and spirit of the invention being indicated by the following claims.

I claim:

1. A bridge for a stringed instrument having a string supporting portion made of an essentially rigid lubricating composition comprising a generally homogeneous mixture of a first component or constituent and a second component or constituent, the first component being an essentially rigid plastic resin material, and the second component being a lubricating material containing one or more ingredients selected from a group comprising polytetrafluoroethylene, a silicone and graphite, the components being in a proportion sufficient to provide adequate lubrication for strings passing over the bridge to reduce frequency of string breakage.

2. A bridge as claimed in claim 1, wherein the composition further includes a third component comprising aramid, carbon or glass fibers or combinations thereof.

3. A bridge as claimed in claim 2, wherein the composition is a mixture of polyphenylene sulfide resin, polytetrafluoroethylene and glass fibers generally in the proportions of 55%, 15% and 30% by weight respectively.

4. A bridge is claimed in claim 1 wherein the first component contains one or more ingredients selected from a group comprising acetal, amino, polyamide, polycarbonate, polyester, polyimide, polyphenylene, styrene-acrylonitrile and polyethersulfone resins.

5. A guitar bridge saddle having a body comprising a generally homogeneous mixture of a first component or constituent and a second component or constituent, wherein the first component contains one or more ingredients selected from a group comprising acetal, amino, polyamide, polycarbonate, polyester, polyimide, polyphenylene, styrene-acrylonitrile and polyethersulfone resins, and the second component is a lubricating material in a proportion sufficient to provide adequate lubrication for strings passing over the bridge to reduce frequency of string breakage.

6. A guitar bridge saddle as claimed in claim 5 wherein the first component is polyphenylene sulfide resin and second component is polytetrafluoroethylene.

7. A guitar bridge saddle as claimed in claim 6, wherein the mixture includes a third component of glass fibers, the first, second and third components being generally in the proportions of 55%, 15% and 30% by weight.

8. A guitar bridge saddle as claimed in claim 5 wherein the second component contains one or more ingredients selected from a group comprising: polytetrafluoroethylene, a silicone and graphite.

9. A method for reducing string breakage in a guitar during playing thereof, the guitar having a bridge, the method comprising the steps of:

(a) removing any metal string contacting portions of the bridge of the guitar;

(b) installing string contacting portions on the bridge with a composition comprising a non-metallic component and a lubricating component; and (c) playing the guitar with said string contacting portions of said composition installed thereon.

10. A method as claimed in claim 9, wherein the non-metallic component is a resin.

11. A method as claimed in claim 10, wherein the lubricating component is polytetrafluoroethylene.

12. A method as in claim 9, wherein the composition comprises:

55% polyphenylene sulfide resin;
15% polytetrafluoroethylene; and
30% glass fibers.

* * * * *